US005862614A

United States Patent [19]

Koh

[11] Patent Number: 5,862,614

[45] Date of Patent: Jan. 26, 1999

[54] INDOOR EXERCISE SHOE AND SOLE THEREFOR

[75] Inventor: Kanae H. Koh, Venice, Calif.

[73] Assignee: Nine West Group, Inc., Stamford, Conn.

[21] Appl. No.: 792,885

[22] Filed: Jan. 31, 1997

[51] Int. Cl.[6] ..... A43B 13/24; A43B 13/26

[52] U.S. Cl. ..... 36/31; 36/59 A; 36/59 C; 36/32 R

[58] Field of Search ..... 36/59 R, 59 A, 36/59 B, 59 C, 30 R, 31, 32 R, 28, 103, 131, 25 R

[56] References Cited

U.S. PATENT DOCUMENTS

| | | | |
|---|---|---|---|
| 354,232 | 12/1886 | Reid . | |
| 2,297,552 | 9/1942 | Hansen | 36/76 |
| 2,408,214 | 9/1946 | Husted | 36/59 C |
| 4,141,158 | 2/1979 | Benseler et al. | 36/32 R |
| 4,160,331 | 7/1979 | Bell | 36/59 B |
| 4,188,737 | 2/1980 | Haver | 36/131 |
| 4,266,349 | 5/1981 | Schmohl | 36/32 R |
| 4,348,821 | 9/1982 | Daswick | 36/103 |
| 4,449,307 | 5/1984 | Stubblefield | 36/32 R |
| 4,507,879 | 4/1985 | Dassler | 36/102 |
| 4,547,983 | 10/1985 | Brandt | 36/131 |
| 4,624,062 | 11/1986 | Autry | 36/114 |
| 4,658,514 | 4/1987 | Shin | 36/30 R |
| 4,662,090 | 5/1987 | Solano | 36/131 |
| 4,697,361 | 10/1987 | Ganter et al. | 36/28 |
| 4,815,222 | 3/1989 | Eisenbach et al. | 36/131 |
| 4,897,936 | 2/1990 | Fuerst | 36/30 A |
| 4,907,355 | 3/1990 | Allen et al. | 36/131 |
| 4,982,737 | 1/1991 | Guttmann | 128/581 |
| 5,077,916 | 1/1992 | Beneteau | 36/114 |
| 5,216,824 | 6/1993 | Blisset et al. | 36/32 R |
| 5,224,279 | 7/1993 | Agnew | 36/30 R |
| 5,282,288 | 2/1994 | Henson | 36/28 |
| 5,423,135 | 6/1995 | Poole et al. | 36/25 R |
| 5,446,977 | 9/1995 | Nagano et al. | 36/131 |

FOREIGN PATENT DOCUMENTS

| | | | |
|---|---|---|---|
| 0411330 A | 2/1991 | European Pat. Off. | 36/28 |

*Primary Examiner*—Paul T. Sewell
*Assistant Examiner*—Anthony Stashick
*Attorney, Agent, or Firm*—Senniger, Powers, Leavitt & Roedel

[57] ABSTRACT

An indoor exercise shoe which is lightweight and has an improved traction feature. The outsole of the shoe includes a primary midfoot element positioned to underlie the arch of the foot. Traction inserts of high traction material are mounted in openings in the primary midfoot element. The traction inserts project outwardly from the midfoot element for engaging and gripping a surface, such as the pedal of a stationary bicycle, under conditions when the midfoot region of the outsole is relied upon for traction.

20 Claims, 4 Drawing Sheets

INDOOR EXERCISE SHOE AND SOLE THEREFOR

BACKGROUND OF THE INVENTION

This invention relates generally to shoes and more particularly to an indoor exercise shoe having a traction enhancing sole feature.

Indoor exercise involves, among other things, aerobic floor exercises requiring movement about the floor and also work on exercise equipment, such as pedalling a stationary bicycle, walking or running on a treadmill or stair machine. Depending upon the movements involved, different traction demands are placed on the shoe. Some floor exercises may involve considerable side-to-side movement while the wearer is on the balls of her feet and on her toes. Walking or running on stationary equipment will rely on the heel and midfoot area of the shoe to provide traction. Generally speaking, there will not be significant side-to-side motion. Different persons will bring different portions of the shoe into engagement with the floor or exercise equipment. For example, some persons will pedal a stationary bicycle with the balls of their feet engaging the pedal. However, others will pedal relying on the midfoot region to provide traction to keep the foot on the pedal.

Another aspect for indoor workout is that the shoe should be as lightweight as possible while providing good protection for the foot and good traction. The shoe will not be exposed to water and highly abrasive surfaces in the indoor workout environment so that different materials may be used.

SUMMARY OF THE INVENTION

Among the several objects and features of the present invention may be noted the provision of an indoor exercise shoe and sole which has good traction under different use conditions; the provision of such a shoe and sole which inhibits slippage when on exercise equipment such as a stationary bicycle; the provision of such a shoe and sole which has good traction in a midfoot region of the outsole; and the provision of such a shoe and sole which is lightweight.

Generally, an indoor exercise shoe of the present invention comprises an upper shaped to define a volume for receiving a foot therein and having a throat for passage of the foot into the volume, and a sole mounting the upper thereon and having an upper surface for supporting the foot. The sole having a bottom including a toe region, a ball region disposed rearwardly of the toe region for underlying the ball of the foot, a midfoot region disposed rearwardly of the ball region for underlying the midfoot and a heel region disposed rearwardly of the midfoot region for underlying the heel. The sole comprises an outsole for engaging a floor. The outsole includes a primary midfoot element located generally in the midfoot region of the sole bottom, and made of a material having a hardness selected to resist wear and protect the midfoot. Multiple openings spaced longitudinally of the shoe from each other each receive a traction insert which projects outwardly from the openings. Each traction insert is made of a material having a hardness selected to substantially conform to a surface engaged by the traction insert for gripping the surface. The hardness of the traction insert material is less than the hardness of the primary midfoot element material. The traction inserts are spaced apart from each other along the length of the shoe in the openings, with the primary midfoot element extending between adjacent traction inserts whereby the traction inserts and primary midfoot element cooperate to provide gripping and traction in the midfoot region.

In another aspect of the present invention, a sole substantially as described above.

Other objects and features of the present invention will be in part apparent and in part pointed out hereinafter.

BRIEF DESCRIPTION OF THE DRAWINGS

Corresponding reference characters indicate corresponding parts throughout several views of the drawings.

DETAILED DESCRIPTION OF THE PREFERRED EMBODIMENT

Figure 1:
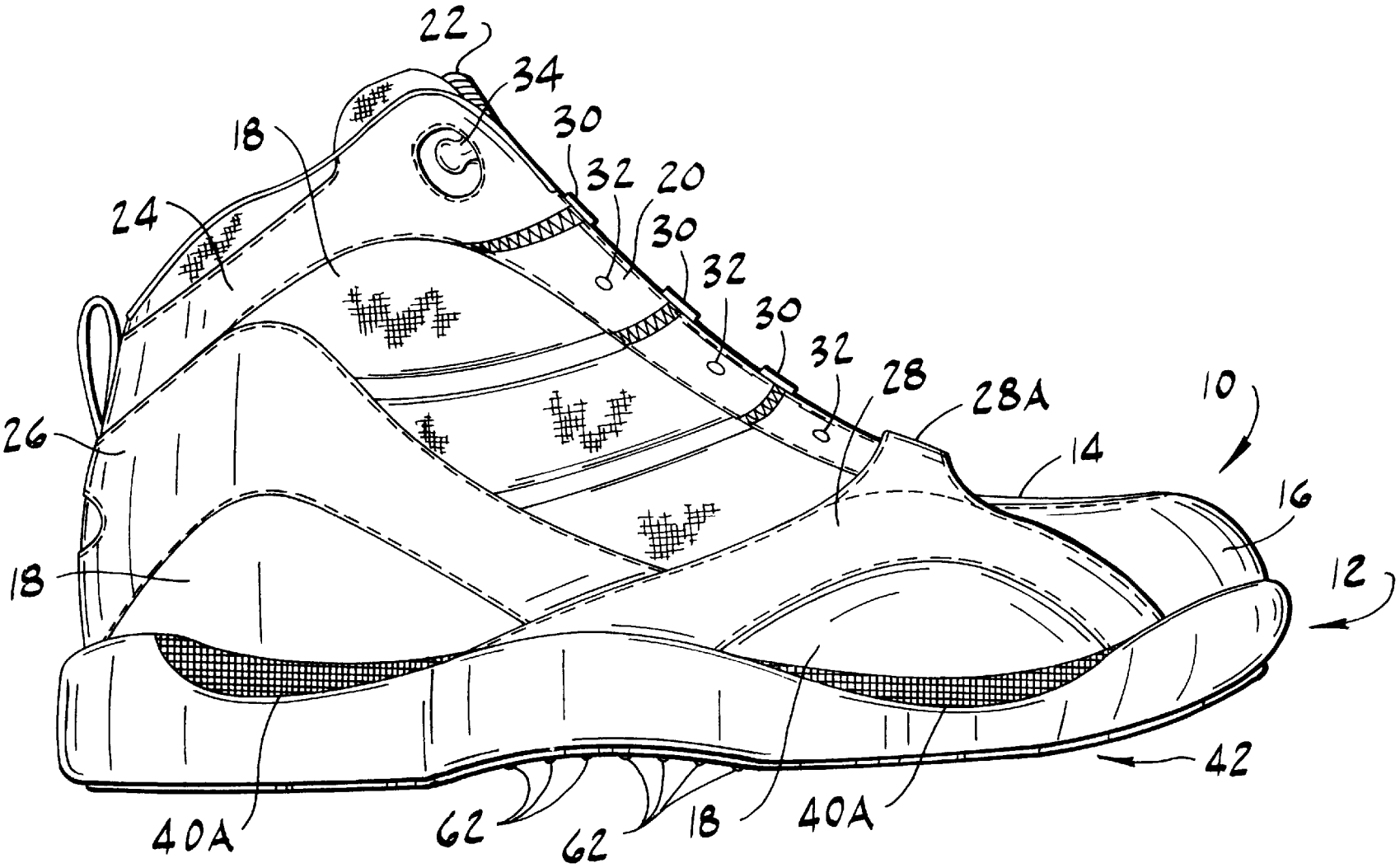
FIG. 1 is a right side elevation of a shoe of the present invention having an outsole and an upper.
Figure 2:
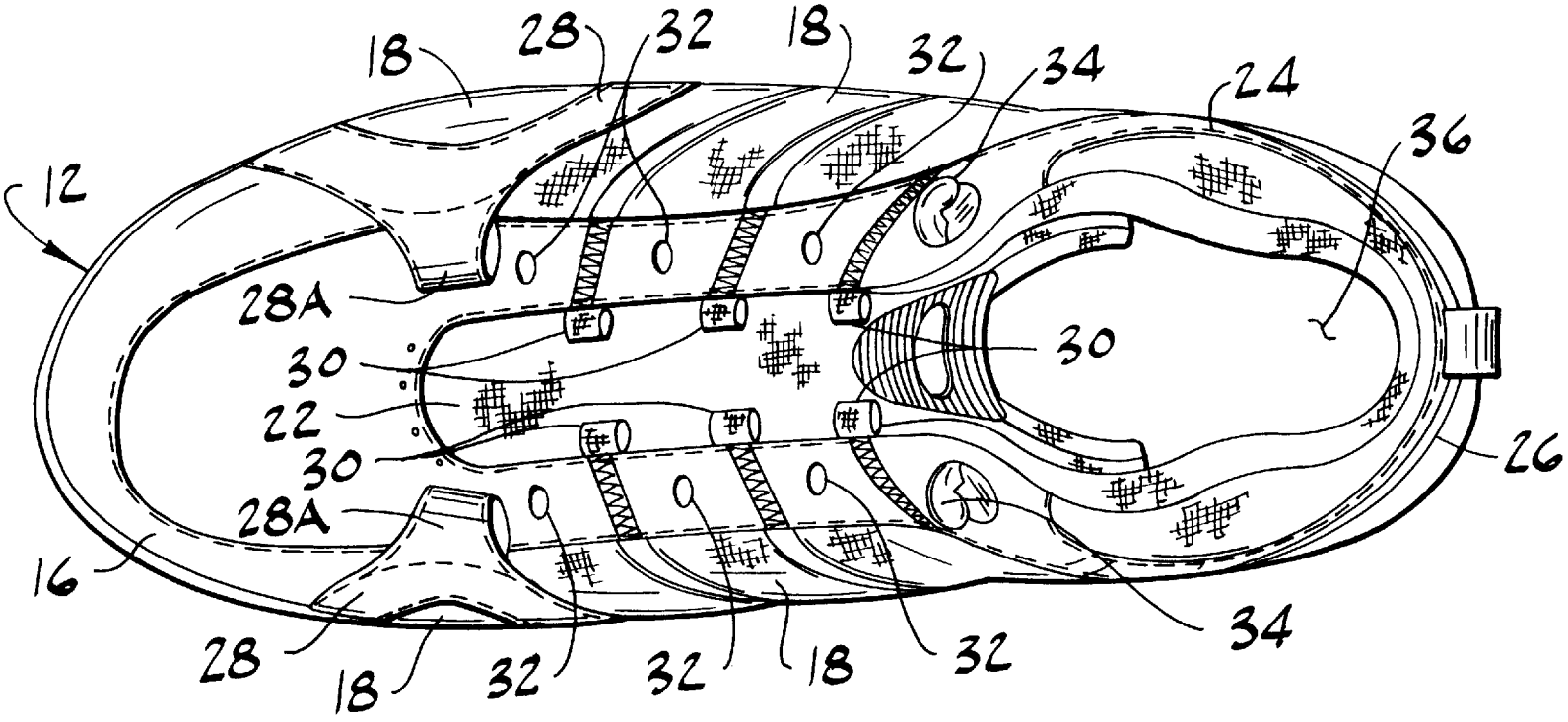
FIG. 2 is a top plan view thereof.

Referring now to the drawings, and in particular to FIGS. 1 and 2, a shoe constructed according to the principles of the present invention is shown to comprise an upper and a sole (generally indicated at 10 and 12, respectively). The upper 10 includes a vamp 14, a tip 16, quarters 18, eyestays 20, a tongue 22, a collar 24 and a counter 26. Additional pieces 28 sewn to the quarters 18 on respective sides of the shoe have a loop 28A for receiving a shoe lace (not shown). The shoelace is received through the loop 28A, as well as other loops 30 and eyelets 32 in the eyestays 20. Hooks 34 at the collar 24 are also provided for the lacing. The illustrated upper 10 is constructed for gillie lacing. Gillie lacing refers to a well known style of lacing a shoe in which the shoelace runs through loops, such as by loops 30. The upper having the above stated construction is shown for illustrative purposes only. The particular construction of the upper may be other than shown without departing from the scope of the present invention.

Figure 3:
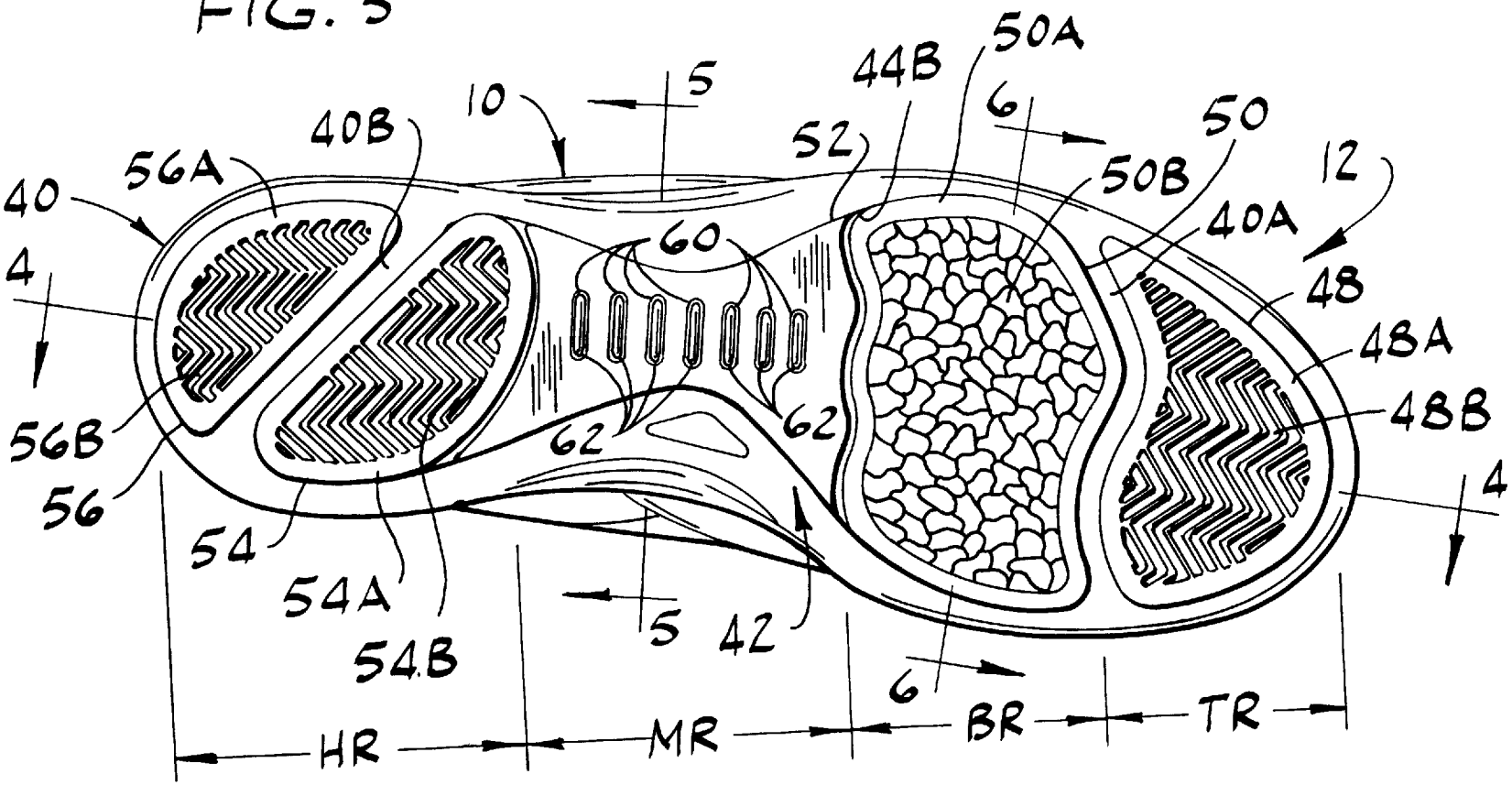
FIG. 3 is a bottom plan view thereof.

The upper 10 is shaped to define a volume for receiving a foot (not shown) and has a throat 36 through which the foot passes into the volume. The throat 36 is defined primarily by the collar 24 and the tongue 22. As shown in FIG. 3, the sole 12 has an upper surface for supporting the foot, and comprises a midsole and an outsole (generally designated at 40 and 42, respectively). An insole and a sockliner which underlie the foot are not illustrated for clarity in the drawings. However, one of ordinary skill in the art would readily understand the construction of these features and their incorporation into the shoe. The midsole 40 is made of EVA in the preferred embodiment and includes portions 40A on each side of the foot (only those on one side being shown) which are formed to have a mesh appearance for decorative purposes. The midsole 40 is undercurved, particularly in the middle of the shoe (FIG. 5) such that bottom surfaces of the midsole 40 form part of the bottom of the shoe. Three recesses (designated 44A, 44B and 44C, respectively) are formed in the bottom of the midsole 40 which receive component inserts of the outsole 42 described in more detail below.

Referring now to FIG. 3, the bottom of the sole 12 includes a toe region TR for underlying the toes, a ball region BR for underlying the ball of the foot, a midfoot region MR for underlying the midfoot and a heel region HR for underlying the heel. These regions are generally demarcated in FIG. 3. A toe insert 48 is attached to the midsole 40 as by gluing in the forward one of the recesses 44A in the toe region TR of the sole bottom. The toe insert 48 projects downwardly from the midsole 40 so that the toe insert, not the midsole engages the floor. The toe insert 48 has a flat border 48A and an interior 48B formed in a herringbone pattern which provides good traction for movement in all directions, including side-to-side motion. The toe insert 48 is made of rubber or other material having a hardness and abrasion resistance suitable for a wear surface of an outsole.

Figure 6:
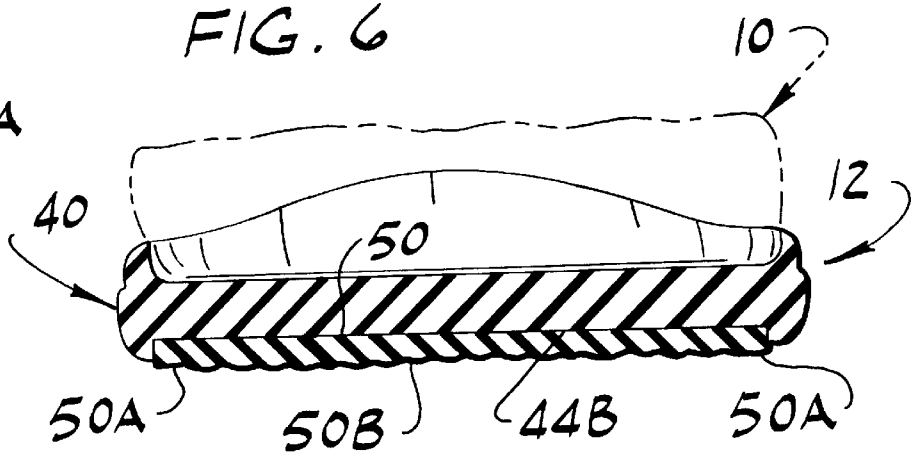
FIG. 6 is a cross section of the outsole taken in the plane including line 6—6 of FIG. 3.

Rearwardly of the toe insert 48 is a ball insert 50 received in a portion of the elongate central one of the recesses 44B in the midsole 40 in the ball region BR of the sole bottom. The ball insert 50 is fixedly attached to the midsole 40 such as by gluing to the midsole in the recess 44B. The toe insert 48 and ball insert 50 are separated by a low ridge 40A of the midsole 40. The ball insert 50 is made of gum rubber, but may be made of another material having suitable, high traction properties. The gum rubber is softer than the rubber of the toe insert 48 and tends to conform to the surface engaged by the insert to provide high traction. Referring to FIGS. 3 and 6, it may be seen that the ball insert 50 has a flat border 50A and a pebbly pattern 50B internally of the border. Like the toe insert 48, the ball insert 50 protrudes from the recess below the midsole 40 so that the ball insert, not the midsole, contacts the floor on the sole bottom.

Figure 4:
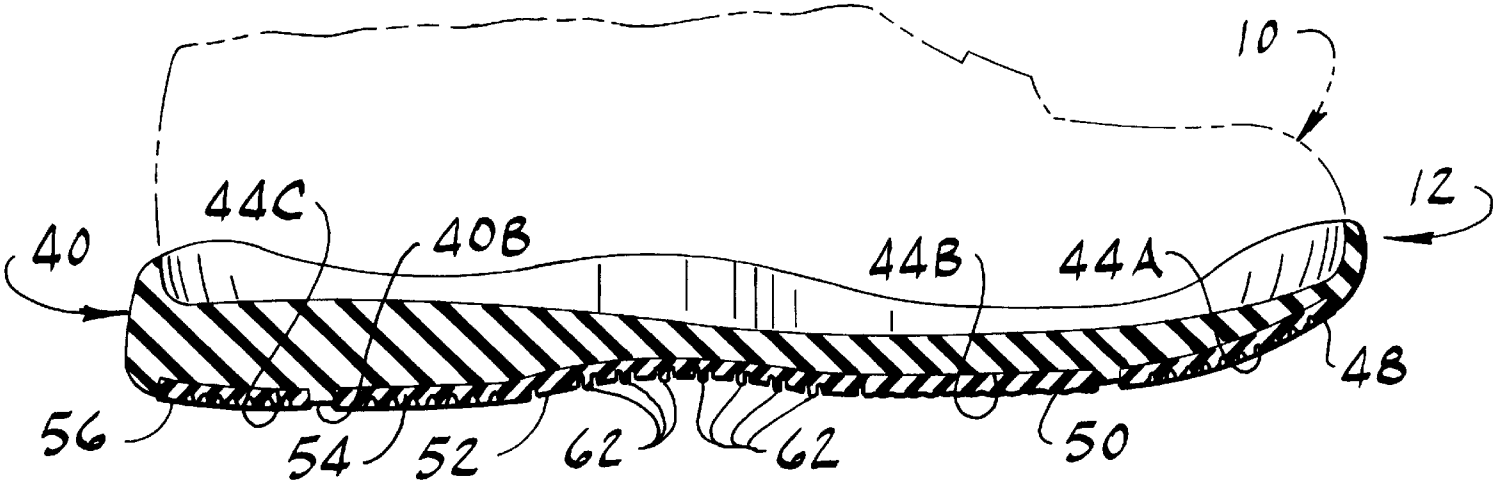
FIG. 4 is a longitudinal section of the outsole (a fragmentary portion of the upper being illustrated in phantom) taken on the line 4—4 of FIG. 3.

The central recess 44B of the midsole 40 also contains a primary midfoot element 52 located rearwardly of the ball insert 50 and lying in the midfoot region MR of the sole bottom. The primary midfoot element 52 and the ball insert 50 are spaced slightly so that a portion of the bottom of the central recess 44B may be seen between them. The primary midfoot element 52 is preferably made of the same rubber (or like material) as the toe insert 48, and is attached such as by gluing to the midsole 40 in the recess 44B. The primary midfoot element 52 is roughly hourglass shaped with its narrowest section substantially in the middle. The midsole 40 arches upwardly in the midfoot region MR and as seen in FIG. 4, the primary midfoot element 52 arches upwardly in conformance with the midsole. Like the other inserts (48, 50), the primary midfoot element 52 protrudes from its recess 44B below the midsole 40 for engaging the floor below the sole bottom.

Rearwardly of the primary midfoot element 52 are a pair of heel inserts (designated 54 and 56, respectively), the first of which is located in the central recess 44B of the midsole 40, and the second of which is located in the rearwardmost recess 44C of the midsole. The first and second heel inserts 54, 56 are preferably made of the same rubber or other suitable material as the toe insert 48. The first and second inserts 54, 56 are attached as by gluing to the midsole 40 in their respective recesses 44B, 44C and protrude from the recesses below the midsole for contacting the floor. The first heel insert 54 is spaced slightly rearwardly from the primary midfoot element 52 so that another portion of the bottom of the central recess 44B is exposed. A generally transversely extending, angled low ridge 40B of the midsole 40 is located between the first heel insert 54 and the second heel insert 56. Both heel inserts have a roughly half moon shape, but the first insert 54 is larger in terms of surface area than the second insert 56 and the orientation of each is the reverse of the other. The first and second heel inserts 54, 56 each have a flat border (54A, 56A) and an interior (54B, 56B) having a herringbone configuration like the toe insert 48.

Figure 5:
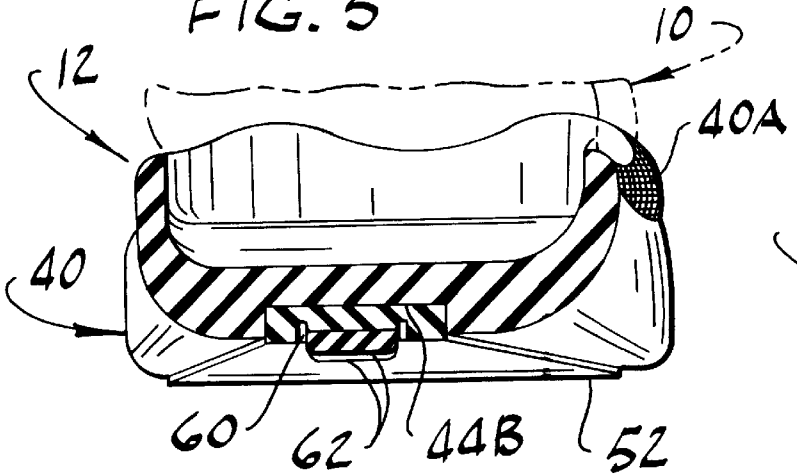
FIG. 5 is a cross section of the outsole taken in the plane including line 5—5 of FIG. 3.

The outsole 42 is particularly provided with a construction to provide traction in those circumstances when the midfoot region MR engages a surface. Although the midfoot region MR often does not come into engagement with the floor, activities such as walking on a treadmill or pedalling a stationary bicycle may rely significantly or solely on the midfoot region for the needed traction. In that regard, the primary midfoot element 52 has a series of oval recesses 60 spaced longitudinally of each other generally along the center of the midfoot element. Referring now also to FIG. 5, each of the recesses 60 contains a traction insert 62 (or rib) which is generally cylindrical with rounded ends. The traction inserts 62 are molded together with the primary midfoot element 52 for an intimate connection with the midfoot element in the recesses 60. The traction inserts 62 are made of gum rubber in the preferred embodiment, but may be made of another material which provides high traction by conforming to the shape of the surface engaged. In addition to being relatively soft, the traction inserts 62 are blunt on their bottom surfaces so they do not act to penetrate the surface engaged. The hardness of the gum rubber is 55–60 Shore A durometer hardness and the hardness of the rubber in the primary midfoot element 52 is 65–70 Shore A durometer hardness. Each traction insert 62 projects out of its corresponding recess 60 and downwardly from the surface of the primary midfoot element 52. However, the traction inserts 62 do not extend below the toe insert 48, ball insert 50 or heel inserts 54, 56 (in a relaxed, unflexed condition of the sole 12) so do not come into contact with the floor or other surface for certain types of activities.

The traction inserts 62 are softer than the primary midfoot element material to grip a surface contacted by the inserts and provide traction. In addition, the spacing of the traction inserts 62 and their projection significantly below the bottom surface of the primary midfoot element 52 allows the traction inserts to act like a series of teeth capable of catching an edge of a surface (e.g., the edge of a stationary bicycle pedal) for holding the shoe on the pedal.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An indoor exercise shoe comprising:

an upper shaped to define a volume for receiving a foot therein and having a throat for passage of the foot into the volume;

a sole mounting the upper thereon and having an upper surface for supporting the foot, the sole having a bottom including a toe region for underlying the toes, a ball region disposed rearwardly of the toe region for underlying the ball of the foot, a midfoot region disposed rearwardly of the ball region for underlying the midfoot and a heel region disposed rearwardly of the midfoot region for underlying the heel, the sole comprising an outsole for engaging a floor, the outsole including a primary midfoot element located generally in the midfoot region of the sole bottom, the primary midfoot element being made of a material having a hardness selected to resist wear and protect the midfoot and including multiple openings spaced longitudinally of the shoe from each other, a traction insert in each of the openings projecting outwardly a distance from the opening, each traction insert being made of a material having a hardness selected to substantially conform to a surface engaged by the traction insert for gripping the surface, the hardness of the traction insert material being less than the hardness of the primary midfoot element material, the traction inserts being spaced apart from each other along the length of the shoe in the openings, the primary midfoot element extending between adjacent traction inserts whereby the traction inserts and primary midfoot element cooperate to provide gripping and traction in the midfoot region;

the sole including the primary midfoot element arching upwardly in the midfoot region from the sole bottom a distance greater than the distance each traction insert projects from its respective opening in the primary midfoot element.

2. A shoe as set forth in claim 1 wherein the traction inserts comprise ribs disposed in the openings in the primary midfoot element, the ribs extending generally transversely of the shoe and having a blunt bottom surface.

3. A shoe as set forth in claim 2 wherein the material of the ribs has a hardness of 55–60 Shore A durometer hardness and the material of the primary midfoot section has a hardness of 65–70 Shore A durometer hardness.

4. A shoe as set forth in claim 3 wherein the ribs are made of gum rubber.

5. A shoe as set forth in claim 4 wherein the sole further comprises a midsole of polymeric material, the midsole including a bottom having a recess formed therein, the primary midfoot element being attached to the midsole in the recess.

6. A shoe as set forth in claim 5 wherein the primary midfoot element of the outsole is spaced inwardly from sides of the midsole, and the midsole curves under from the side of the sole to the midfoot region.

7. A shoe as set forth in claim 5 wherein the outsole further comprises a toe insert disposed for underlying the toes of the foot, a ball insert disposed for underlying the ball of the foot, and a heel insert disposed for underlying the heel of the foot, the midsole bottom having recesses receiving the toe, ball and heel inserts with the inserts protruding outwardly from the recesses.

8. A shoe as set forth in claim 7 wherein the ball insert of the outsole is made of a material having a hardness less than the hardness of the primary midfoot element material.

9. A shoe as set forth in claim 8 wherein the material of the ball insert is gum rubber.

10. A sole for a shoe having a bottom including a toe region for underlying the toes, a ball region disposed rearwardly of the toe region for underlying the ball of the foot, a midfoot region disposed rearwardly of the ball region for underlying the midfoot and a heel region disposed rearwardly of the midfoot region for underlying the heel, the sole comprising an outsole for engaging a floor, the outsole including a primary midfoot element located generally in the midfoot region of the sole bottom, the primary midfoot element being made of a material having a hardness selected to resist wear and protect the midfoot and including multiple openings spaced longitudinally of the shoe from each other, a traction insert in each of the openings projecting outwardly a distance from the opening, each traction insert being made of a material having a hardness selected to substantially conform to a surface engaged by the traction insert for gripping the surface, the hardness of the traction insert material being less than the hardness of the primary midfoot element material, the traction inserts being spaced apart from each other along the length of the shoe in the openings, the primary midfoot element extending between adjacent traction inserts whereby the traction inserts and primary midfoot element cooperate to provide gripping and traction in the midfoot region;

the sole including the primary midfoot element arching upwardly in the midfoot region from the sole bottom a distance greater than the distance each traction insert projects from its respective opening in the primary midfoot element.

11. A sole as set forth in claim 10 wherein the traction inserts comprise ribs disposed in the openings in the primary midfoot element, the ribs extending generally transversely of the sole and having a blunt bottom surface.

12. A sole as set forth in claim 11 wherein the material of the ribs has a hardness of 55–60 Shore A durometer hardness and the material of the primary midfoot section has a hardness of 65–70 Shore A durometer hardness.

13. A sole as set forth in claim 12 wherein the ribs are made of gum rubber.

14. A sole as set forth in claim 13 wherein the sole further comprises a midsole of polymeric material, the midsole including a bottom having a recess formed therein, the primary midfoot element being attached to the midsole in the recess, the primary midfoot element of the outsole being spaced inwardly from sides of the midsole, and the midsole curving under from the side of the sole to the midfoot region.

15. A sole as set forth in claim 14 wherein the outsole further comprises a toe insert disposed for underlying the toes of the foot, a ball insert disposed for underlying the ball of the foot, and a heel insert disposed for underlying the heel of the foot, the midsole bottom having recesses receiving the toe, ball and heel inserts with the inserts protruding outwardly from the recesses.

16. A sole as set forth in claim 15 wherein the ball insert of the outsole is made of gum rubber having a hardness less than the hardness of the primary midfoot element material.

17. A sole as set forth in claim 10 wherein the primary midfoot element of the outsole is spaced inwardly from sides of the midsole, and the midsole curves under from the side of the sole to the midfoot region.

18. A shoe as set forth in claim 1 wherein the primary midfoot element of the outsole is spaced inwardly from sides of the midsole, and the midsole curves under from the side of the sole to the midfoot region.

19. An indoor exercise shoe comprising:

an upper shaped to define a volume for receiving a foot therein and having a throat for passage of the foot into the volume;

a sole mounting the upper thereon and having an upper surface for supporting the foot, the sole having a bottom including a toe region for underlying the toes, a ball region disposed rearwardly of the toe region for underlying the ball of the foot, a midfoot region disposed rearwardly of the ball region for underlying the midfoot and a heel region disposed rearwardly of the midfoot region for underlying the heel, the sole comprising an outsole for engaging a floor, the outsole including a primary midfoot element located generally in the midfoot region of the sole bottom, the primary midfoot element being made of a material having a hardness selected to resist wear and protect the midfoot and including multiple openings spaced longitudinally of the shoe from each other, a traction insert in each of the openings projecting outwardly from the opening, each traction insert being made of a material having a hardness selected to substantially conform to a surface engaged by the traction insert for gripping the surface, the hardness of the traction insert material being less than the hardness of the primary midfoot element material, the traction inserts being spaced apart from each other along the length of the shoe in the openings, the primary midfoot element extending between adjacent traction inserts whereby the traction inserts and primary midfoot element cooperate to provide gripping and traction in the midfoot region, the traction inserts comprising ribs disposed in the openings in the primary midfoot element, the ribs extending generally transversely of the shoe and having a blunt bottom surface, the material of the ribs having a hardness of 55–60 Shore A durometer hardness and the material of the primary midfoot section having a hardness of 65–70 Shore A durometer hardness.

20. A sole for a shoe having a bottom including a toe region for underlying the toes, a ball region disposed rearwardly of the toe region for underlying the ball of the foot, a midfoot region disposed rearwardly of the ball region for underlying the midfoot and a heel region disposed rearwardly of the midfoot region for underlying the heel, the sole comprising an outsole for engaging a floor, the outsole including a primary midfoot element located generally in the midfoot region of the sole bottom, the primary midfoot element being made of a material having a hardness selected to resist wear and protect the midfoot and including multiple openings spaced longitudinally of the shoe from each other, a traction insert in each of the openings projecting outwardly from the opening, each traction insert being made of a material having a hardness selected to substantially conform to a surface engaged by the traction insert for gripping the surface, the hardness of the traction insert material being less than the hardness of the primary midfoot element material, the traction inserts being spaced apart from each other along the length of the shoe in the openings, the primary midfoot element extending between adjacent traction inserts whereby the traction inserts and primary midfoot element cooperate to provide gripping and traction in the midfoot region, the traction inserts comprising ribs disposed in the openings in the primary midfoot element, the ribs extending generally transversely of the sole and having a blunt bottom surface, the material of the ribs having a hardness of 55–60 Shore A durometer hardness and the material of the primary midfoot section having a hardness of 65–70 Shore A durometer hardness.

* * * * *